United States Patent [19]

Shyers

[11] 4,341,307

[45] Jul. 27, 1982

[54] CONTAINER HAVING INTERLOCKING BASE AND CLOSURE

[76] Inventor: Richard H. Shyers, 343B Long Rd., Basking Ridge, N.J. 07920

[21] Appl. No.: 178,829

[22] Filed: Aug. 18, 1980

[51] Int. Cl.[3] ..... B65D 1/34; B65D 85/67

[52] U.S. Cl. ..... 206/387; 220/306; 220/339; 229/2.5 R

[58] Field of Search ..... 206/387, 472; 220/339, 220/306; 229/2.5

[56] References Cited

U.S. PATENT DOCUMENTS 3,640,379 2/1972 Weingarden ..... 206/387

3,743,081 7/1973 Roberg et al. ..... 206/387

3,902,598 9/1975 Koob et al. ..... 206/387

*Primary Examiner*—William T. Dixson, Jr.

*Attorney, Agent, or Firm*—Eugene E. Geoffrey, Jr.

[57] ABSTRACT

A container including a base and interlocking closure, each having a peripheral hollow wall with the base wall having a peripheral portion of reduced thickness adjoining the edge thereof and the closure wall having a corresponding cooperating peripheral portion of reduced thickness. The thickness of the engaging walls of the wall portions of reduced thickness being tapered with the thickest portion near the outer edge. The peripheries of the base and closure walls are substantially identical whereupon engagement of the closure with the base will cause the cover to interlock with the base.

6 Claims, 11 Drawing Figures

10
11
12
13
14
15
16
18
19
20
21
22
23
24
25
26
27
28
29
30
31
38

CONTAINER HAVING INTERLOCKING BASE AND CLOSURE

This invention relates to containers for articles such as magnetic tapes, cosmetics, tools and the like and more specifically to a novel and improved container formed of plastic and other similar materials having base and closure portions which automatically interlock to hold the closure in place and which can be readily disengaged for access to the contents.

While a great variety of containers of plastic and similar materials have been made with interlocking base and closure portions, known structures embody relatively complicated configurations utilizing a variety of locking means such as indents, peripheral flanges, snap locks and the like. Such locking means however, which are also formed of plastic, are often easily deformed or broken and are not generally useful for containers as large as a square foot in area.

This invention overcomes the difficulties heretofore encountered with containers having interlocking base and closure portions and provides a novel and improved structure of plastic or other similar material which provides a secure and durable interlock between the closure and base and at the same time vents the container to maintain ambient atmospheric pressure within the closed container.

Another object of the invention resides in the provision of a base and closure therefor which are hinged one to the other to simulate a book having relatively stiff outer surfaces coupled by a spine. In this way, the base and closure are coupled one to the other and upon engagement substantially automatic alignment is attained.

Another object of the invention resides in the provision of a novel and improved container, formed of plastic or similar materials, having interlocking base and closure portions each of which may be formed by known plastic forming procedures, as for instance vacuum forming and the like.

Still another object of the invention resides in the provision of a novel and improved container and interlocking closure therefor which is characterized by its simplicity, low cost, ease of operation and reliability.

A further object of the invention resides in the provision of a novel and improved container having hinged base and closure portions.

The container in accordance with the invention, which may assume a variety of configurations, has a base and closure each having a hollow peripheral wall with the wall of said base having an outer recess adjoining the upper edge which forms a shoulder and the closure wall has a similar inner recess adjoining the edge and also forming a shoulder. The plastic is formed so that the thickness of the plastic forming the outer face and adjoining corners of both walls have a thickness approximately equal to the thickness of the plastic stock while the thickness of the plastic adjoining the shoulders is approximately one half the thickness of the stock. With this arrangement, the interlocking recessed portions co-act so that the heavier outer faces of the base and closure deflect the thinner wall portions adjoining the shoulders on the base and closure to hold the closure securely on the base. By affixing the base and closure of the container to relatively rigid members joined by a spine, the base and closure are automatically aligned and when the container is closed, so that the resulting structure simulates a book in configuration.

The above and other objects and advantages of the invention will become more apparent from the following description and accompanying drawings forming part of this application.

Figures 1, 2, 3, 4, 5:
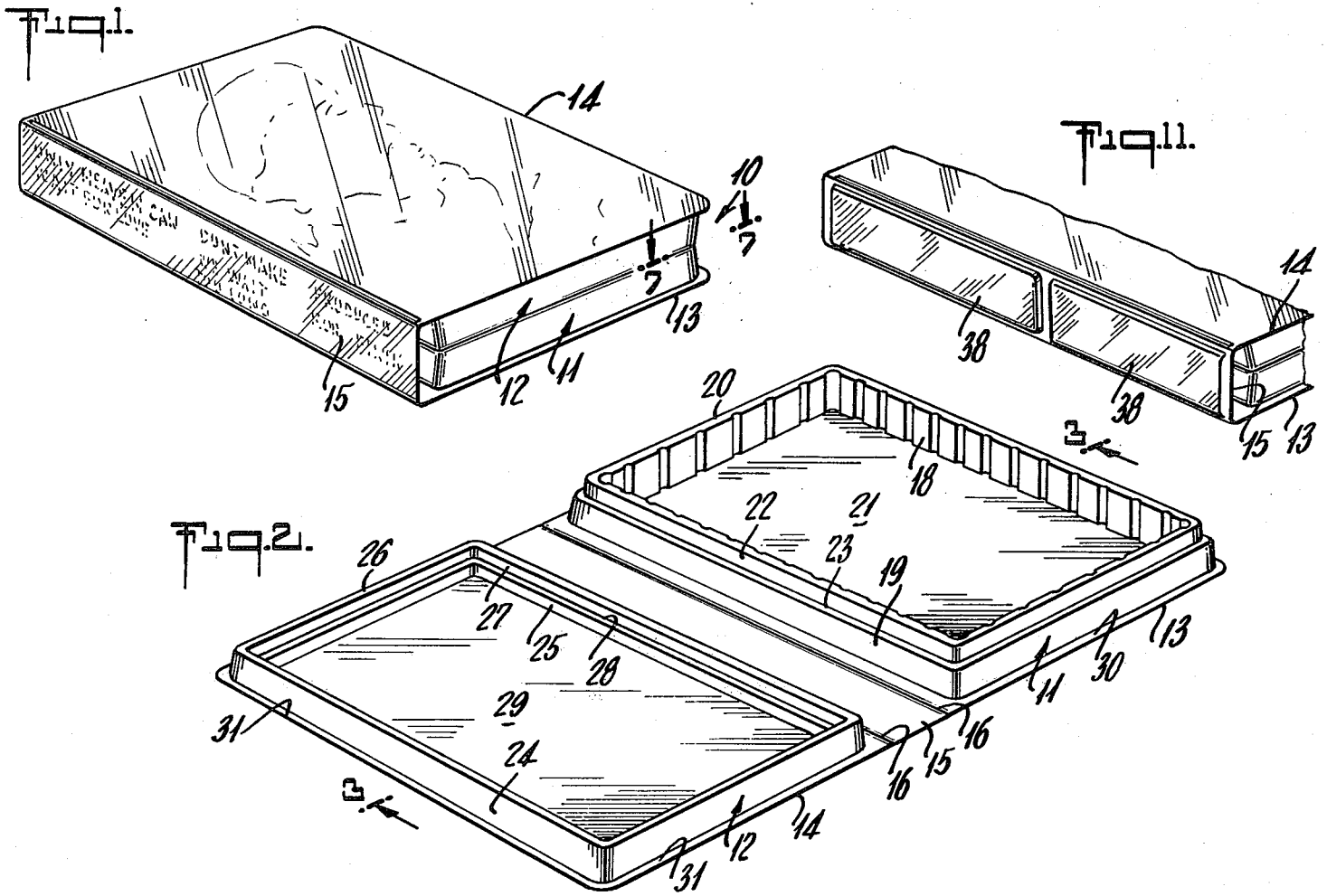
FIG. 1 is a perspective view of one embodiment of an article container in accordance with the invention wherein the container base and closure are hinged one to the other.
FIG. 2 is a perspective view of the container of FIG. 1 in the open position.
FIG. 3 is a cross sectional view of FIG. 2 taken along the line 3—3 thereof.
FIG. 4 is an exploded view of the structure shown in FIG. 3 to illustrate the individual elements prior to assembly.
FIG. 5 is an exploded view similar to FIG. 4 illustrating a modification thereof.
Figures 3, 4, 5:
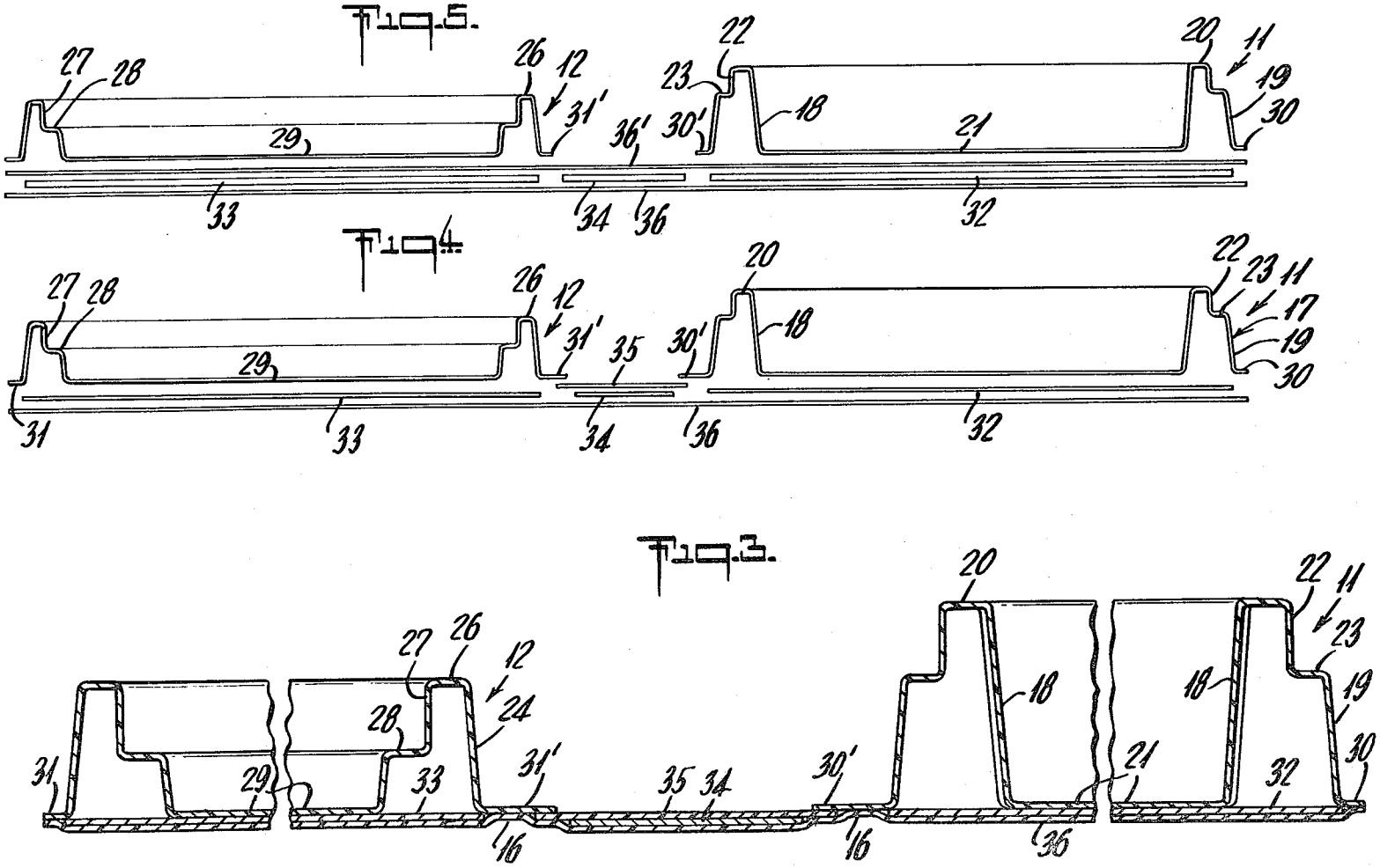
Figures 6, 7, 8, 9, 10:
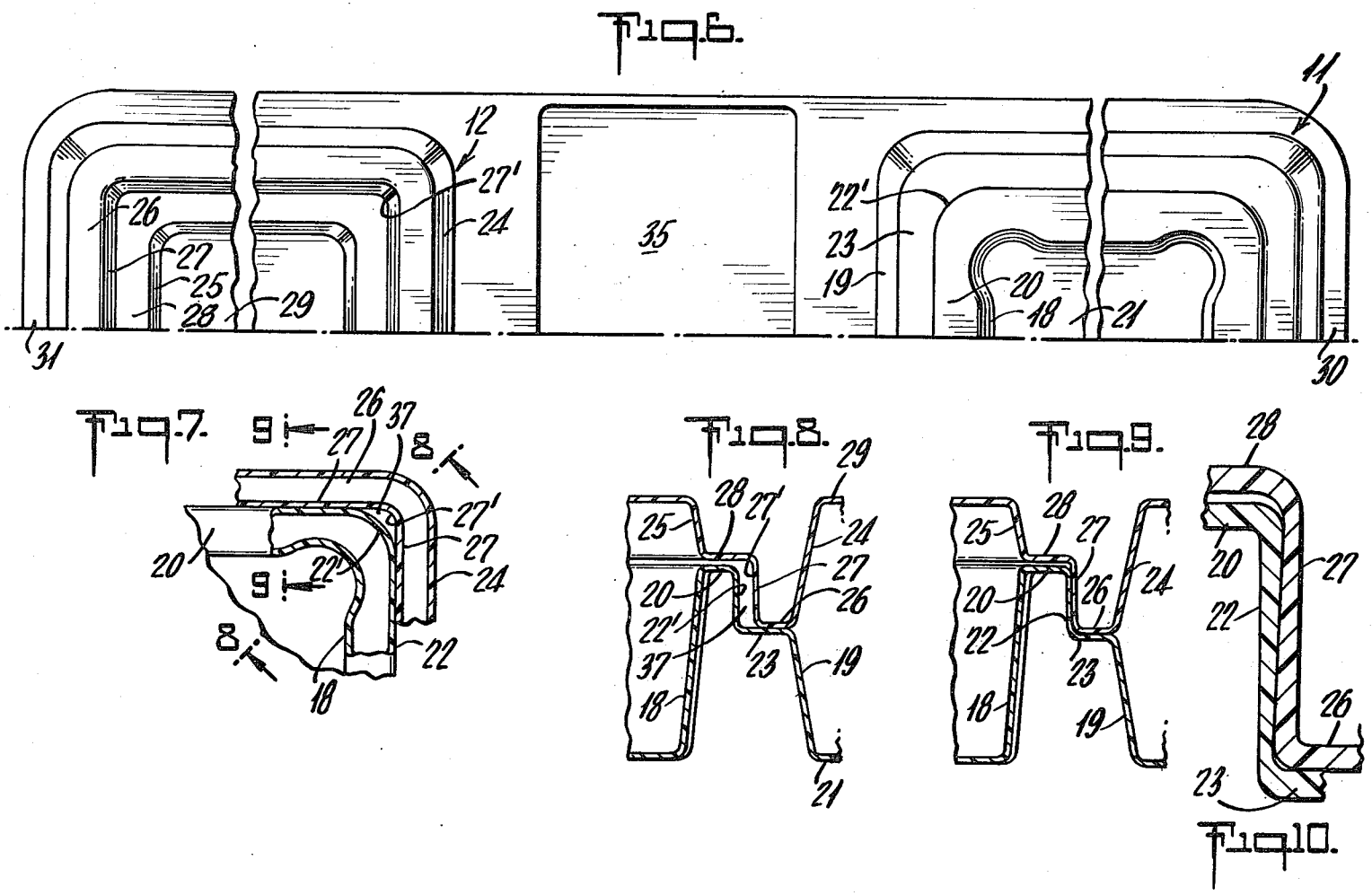
FIG. 6 is a plan view of a fragmentary portion of the structure shown in FIGS. 2 and 3.
FIG. 7 is a cross sectional view of FIG. 1 taken along the line 7—7 thereof.

FIGS. 8 and 9 are cross sectional views of FIG. 7 taken along the lines 8—8 and 9—9 thereof;

FIG. 10 is a greatly enlarged cross sectional view of a portion of FIG. 9 to illustrate the locking feature; and FIG. 11 is perspective view of the spine portion of the container of FIG. 1 showing an indicia card pocket affixed thereto.

The container in accordance with the invention is provided with base and closure portions which are designed to be readily engaged and disengaged and when in the engaged position are retained in the engaged position by reason of the novel and improved configuration of both the base and the closure. The base and closure structures are particularly adaptable for attachment to cover portions coupled by a spine as in the case of an ordinary book to facilitate engagement and disengagement of the closure from the base. As will become evident, the container in accordance with the invention is useful for holding a wide variety of articles such as magnetic tape cassettes and cartridges for both audio and video recording, tools, cosmetics and other similar items. In each instance, the container can be provided with a suitable configuration and arrangement of partitions to accomodate the articles to be retained therein. For the purposes of this description, the invention is illustrated in a so-called book form though it will become evident that the base and closure portions of the container can be formed as individual elements.

Referring now to the drawings, the container in accordance with the invention is shown in perspective in FIGS. 1 and 2 with FIG. 1 illustrating the container in the closed position while FIG. 2 illustrates the container in the open position. The container is generally denoted by the numeral 10 which comprises a base 11 and a closure 12. The base 11 is affixed to a relatively rigid sheet of material 13 such as plastic or the like while the cover 12 is affixed to a second relatively rigid sheet 14 also of plastic or other similar material. The sheets 13 and 14 are coupled by a relatively rigid spine 15 by way of hinge portions 16 so that the closure 12 may be readily folded onto the base 11. At the same time, the closure and base are automatically aligned to facilitate closure.

FIG. 3 illustrates, in cross section, the constructional details of the container as illustrated in FIG. 2 while FIG. 4 is an exploded view of FIG. 3 in diagrammatic form showing individual elements of the structure prior to assembly. More specifically, the base portion 17 is formed with a hollow wall structure having an inner wall 18 and an outer wall 19 coupled by an outer face 20. The wall 18 has a gradual slope from the face 20 to the bottom 21 of the base while the outer wall portion 19 has a recess formed by a substantially vertical wall 22 and a horizontal wall or shoulder 23. As will be described specifically in connection with FIGS. 9 and 10, the thickness of the vertical wall portion 22 is tapered so that the thickness at its point of joinder with the outer face 20 is roughly twice the thickness of the wall at its point of joinder with the shoulder 23. As will be described, this particular structure when cooperating with the closure 12 provides a secure attachment of the closure 12 to the base 11.

The closure 12 is formed in a manner similar to the base 11 in that it is provided with a hollow peripheral wall having an outer wall portion 24, an inner wall portion 25 and an outer face 26. The wall portion 25 is provided with a recess formed by a substantially vertical wall section 27 and a shoulder 28. The wall portion 27 as in the case of the wall portion 22 of the base 11, tapers in thickness from the outer face 26 to the shoulder 28 so that the thickness of the wall portion adjoining the face 26 is approximately twice the thickness of the bottom adjoining the shoulder 28. As previously mentioned, this configuration cooperates with the corresponding configuration on the base and effects an interlocking of the closure with the base as will be described. The base 12 also has a top member 29 formed integrally with the inner wall portion 25.

The outer peripheral wall portions 19 and 24 of the base and closure 11 and 12, respectively, terminate in peripheral flanges 30 and 31. These flanges extend about the periphery of the base and closure with the adjoining flange portions of the base and container 30' and 31' being somewhat wider to facilitate assembly and the formation of the hinged means 16 as illustrated in FIG. 2.

In the assembly of the base and closure as shown in FIGS. 3 and 4, a relatively stiff sheet 32 is placed in underlying relationship to the bottom 21 and extends in all directions to points approximately coincident with the outer wall portion 19 as illustrated more clearly in FIGS. 3 and 4. A similar sheet of material 33 underlies the closure 12. A third piece of relatively stiff material 34 is positioned between the flange portions 30' and 31' and forms the spine which is generally denoted by the numeral 15 in FIGS. 1 and 2. A relatively thin piece of plastic or other suitable material 35 overlies the element 34 and underlies the flanges 30' and 31'. A single sheet 36 of plastic or other suitable material extends beneath both the closure 11 and base 12 as illustrated and the flanges 30, 31, 30' and 31' are adhered to this sheet as illustrated more clearly in FIG. 3. With this arrangement and since the flange portions 30' and 31' are adhered directly to the backing sheet 36, the areas 16 which are of relatively thin section form the hinges to permit the closure to be moved into engagement with the base. At the same time, the distance between the two hinges is roughly equivalent to the total height of the base with the closure in place. In this way, the spine 15 also functions to align the closure with the base to facilitate engagement thereof.

Referring now to FIG. 7 which is a cross sectional view of one corner of the base and closure in the engaged position, it will be observed that the corner of closure 12 in the vicinity of the vertical wall portion 27 is formed with a relatively sharp radius 27'. The corner portion of the base 11 formed by adjoining vertical wall portions 22 is formed on a much larger radius 22' thus forming an opening 37 at each corner of the closed container. In actual practice, this opening facilitates the transfer of air to and from the closed container and thus facilitates secure closure of the container and at the same time provides for the maintenance of ambient atmospheric pressure within the container.

FIGS. 9 and 10 illustrate the interlocking feature in accordance with the invention and it will be observed that FIG. 10 constitutes a greatly enlarged fragmentary portion of FIG. 9. In FIG. 9, it will be observed that the corresponding portions 22 and 27 of the base and closure fit snuggly one against the other when the closure is in position on the base. As previously mentioned, the portions 22 and 27 of the base and closure, respectively, are tapered and this taper is illustrated clearly in FIG. 10. Referring to the outer face 20 and the vertical wall 22 of the base, it will be observed that the wall 22 tapers downwardly to about one half of its original thickness and the same situation occurs with reference to the wall 27 forming part of the closure. Since the outer face 20 of the base and the adjoining corner portion is relatively heavy, the closure, when engaged with the base, will effect a slight deflection of the thinner portion of the wall 27 and similarly since the outer face 26 of the closure is also relatively heavy and the lower section of the wall 22 is relatively thin, the wall 22 will also be deflected. As a result, an interlocking action occurs which holds the closure securely to the base.

A slightly modified form of the invention is illustrated in FIG. 5. In this figure, corresponding elements appearing in FIG. 4 have been denoted by like numerals. It will be observed that all of the elements of FIG. 4 are incorporated in FIG. 5 but that in FIG. 5 the sheet of plastic 35 is substantially coextensive with the sheet of plastic 36 and denoted by the numeral 36'. With the utilization of dual plastic layers 36 and 36', a somewhat more durable structure can be fabricated or in the alternative the sheets 36 and 36' can be reduced in thickness so that the combined thickness will equal the thickness of the sheet 36' as illustrated in FIG. 4.

When utilizing the container in accordance with the invention for housing items such as magnetic tapes and the like, it is desirable to provide means for indicating the contents of the container. One such structure is illustrated in FIG. 11 which includes pockets 38 of a clear plastic material secured along two or more of the edges to the spine 15. A similar pocket arrangement can also be made on one or the other of the outer covers 13 or 14 as may be desired.

While only certain embodiments of the invention have been illustrated and described, it is understood that alterations, changes and modifications may be made therein without departing from the true scope and spirit thereof.

What is claimed is:

1. A container having a base and interlocking closure therefor, said container base comprising a bottom wall, a peripheral hollow side wall extending therefrom, said side wall having an inner peripheral wall portion and an outer peripheral wall portion joined by a flat outer face, said outer wall portion being stepped along a line spaced from said outer face forming an inwardly extending shoulder, said flat outer face and adjoining corners being of relatively heavy thickness with the wall of the stepped portion adjoining said shoulder being thinner than said outer face and said adjoining corners, said closure comprising a top wall and a peripheral hollow side wall extending therefrom, the last said side wall having an inner wall portion and an outer wall portion joined by a flat outer face, said inner wall portion being stepped near the edge thereof forming an inwardly extending shoulder, the last said flat outer face and adjoining corners being of relatively heavy thickness with the wall of the stepped portion adjoining the last said shoulder being thinner than the last said flat outer face and adjoining corners, the outer periphery of the first said flat outer face of said container base being substantially the same in size and configuration as the inner periphery of the flat outer face of said closure whereby said container base and closure will firmly interlock upon being pressed into engagement.

2. A container according to claim 1 wherein the bottom wall of said base is formed integrally with said inner wall portion thereof, the top wall of said closure is formed integrally with the inner wall portion thereof and the outer walls of said base and closure are affixed to flat elements substantially coextensive with the outer walls of said base and closure.

3. A container according to claim 2 wherein said base and closure are rectangular in configuration with the radius of each outer corner of said outer face of said base having a radius greater than the radius of each inner corner of said closure outer face.

4. A container according to claim 2 wherein said flat elements are flexibly hinged to a relatively rigid spine member having a width approximately equal to the height of the container whereby said base and closure are aligned by said spine member to facilitate engagement thereof.

5. A container according to claim 4 wherein said outer wall portions of said base and closure terminate in outwardly formed flange portions, said flat elements each have a size and configuration corresponding to the size and configuration of the edge of the outer wall portions of the base and closure whereby said flanges project beyond the edges of said flat elements, said spine member has a width less than the distance between the flanges of the base and closure when in the engaged position and determines the spacing between the base and closure when in the open position, a first sheet of plastic overlying the spine member and underlying the adjoining flanges of said base and cover, and a second sheet of plastic underlying said flat elements and spine member and coextensive with said base and closure positioned in coplanar relationship with said spine member therebetween, said base and cover flanges being sealed to said second plastic sheet with the adjoining flanges of said base and closure being sealed to said first plastic sheet and to said second plastic sheet whereby said base and closure each hinge about said spine member when moved to and from the closed position.

6. A container according to claim 5 wherein said first sheet of plastic is coextensive with said second sheet of plastic.

* * * * *